US005321934A

United States Patent [19]

Bech

[11] Patent Number: 5,321,934

[45] Date of Patent: Jun. 21, 1994

[54] METHOD OF SEALING JARS

[76] Inventor: Johan N. Bech, 214 Dexter St., Elk Rapids, Mich. 49629

[21] Appl. No.: 955,498

[22] Filed: Oct. 2, 1992

[51] Int. Cl.[5] ..... B65B 7/28; B65B 51/10; B65B 51/22; B67B 3/20

[52] U.S. Cl. ..... 53/478; 53/490; 53/329.2; 53/331.5

[58] Field of Search ..... 53/478, 329.2, 329.3, 53/329.5, 141, 487, 490, 331.5

[56] References Cited

U.S. PATENT DOCUMENTS

| | | | |
|---|---|---|---|
| 3,048,954 | 8/1962 | Abel . | |
| 3,274,748 | 9/1966 | Roberts et al. . | |
| 3,289,383 | 12/1966 | Foss | 53/478 X |
| 3,343,336 | 6/1967 | Bradford . | |
| 3,460,310 | 8/1969 | Adcock et al. | 53/478 |
| 3,491,510 | 1/1970 | Sternau . | |
| 3,548,140 | 12/1970 | O'Neill . | |
| 3,729,897 | 5/1973 | Howe . | |
| 3,815,314 | 6/1974 | Pollock et al. | 53/478 X |
| 3,946,540 | 3/1976 | Solberg et al. . | |
| 4,180,961 | 1/1980 | Collins, III . | |
| 4,258,529 | 3/1981 | Smith | 53/478 |
| 4,362,002 | 12/1982 | Rowland et al. | 53/478 |
| 4,442,129 | 4/1984 | Niwa et al. | 53/478 X |
| 4,719,740 | 1/1988 | Gach | 53/478 X |
| 4,738,080 | 4/1988 | Stockebrand | 53/478 |
| 4,767,016 | 8/1988 | Cook, Jr. et al. . | |
| 5,056,296 | 10/1991 | Ross et al. | 53/478 |

FOREIGN PATENT DOCUMENTS

| | | |
|---|---|---|
| 6375509 | 10/1989 | Japan . |
| 1373595 | 11/1974 | United Kingdom . |
| 2137971 | 10/1984 | United Kingdom . |
| 1265277 | 1/1990 | United Kingdom . |

*Primary Examiner*—Horace M. Culver
*Attorney, Agent, or Firm*—Dykema Gossett

[57] ABSTRACT

A method for capping jars to achieve a seal includes the step of heating the cap prior to placement on the jar. The heated cap is placed on the jar and tightened. The cap and jar are then heated to actuate a seal received in the cap.

16 Claims, 2 Drawing Sheets

METHOD OF SEALING JARS

BACKGROUND OF THE INVENTION

This application relates to a method of attaching lids or caps to jars to insure that seals are properly made.

In the prior art, food products are often packaged in glass jars. Caps tightened onto jars often have an aluminum seal received within the cap. An outer face of the aluminum seal contains an adhesive, and the cap is screwed onto the jar. The cap and glass jar are heated together to melt the adhesive, and seal the aluminum seal on the jar.

Applicant has found this method somewhat unsatisfactory. An undesirably high percentage of the aluminum seals do not properly seal. This is particularly true when the jar is glass, and the cap is plastic. It is believed the various coefficients of expansion in a heated glass jar, the aluminum foil, and the plastic cap, allow relative creeping therebetween which results in an ineffective or improper seal between the cap and the glass jar. When a cold cap with an inner foil membrane has been sealed in an induction sealer onto a container the caps have a tendency to back off and has to be re-torqued. Applicant has developed a system or method to reduce the amount of creepage between the three materials.

In the present invention, the cap is heated prior to being placed on the jar. The jar is left unheated as the cap is attached. The cap and jar are then heated to seal the aluminum. Applicant has found that such a method results in a very high percentage of jars receiving a proper seal.

SUMMARY OF THE INVENTION

In a disclosed method according to the present invention, a plastic cap carrying an aluminum seal is heated. The cap is then placed on a glass jar and seated. As the cap is moved onto the glass jar the aluminum seal is brought into contact with the glass jar. Since the cap has been heated, adhesive disposed on the aluminum seal has been softened. Further, the heated cap begins to heat the jar. The heated cap and the attached jar may then be heated to further activate the adhesive. The aluminum seal is then adhesively bonded to the glass jar. Applicant has found that such a method results in an unexpectedly high percentage of proper seals between each aluminum seal and glass jar.

It is believed that the initial heating of the cap as it is placed on the jar begins to soften the adhesive such that the adhesive begins to conform to the glass jar prior to the glass jar being heated. Further, by slowly warming the glass Jar through the heated cap one reduces the thermal shock that was applied to both the cap and the jar by the prior art method. Thus, the method of the present invention slowly heats the jar, and allows the seal adhesive to begin to conform to any irregularities on the neck of the jar, prior to the adhesive being fully activated by the second heater. It is believed that these reasons at least in part explain the increase in the number of proper seals achieved with the present invention over the prior art method.

In other features of the present invention, the cap is heated in a chute that delivers the cap to a station which tightens the cap on the jars. Thus, additional stations are not required. Rather, the initial heating of the cap is incorporated into the standard conveyor assembly for moving the caps to the jars.

Further, in another feature of the present invention, the plastic cap is heated to a range of 120°-250° F. prior to being placed on the jar. In one most preferred embodiment the cap was heated to approximately 240° F.

Finally, in an alternative embodiment, the aluminum seal is formed such that it extends for a greater radial distance than the glass jar. The cap is shaped such that it curls the excess portion of the aluminum seal axially downwardly around the outer peripheral surface of the neck of the glass jar. This also insures a better seal than prior art methods.

These and other features of the present invention can be best understood from the following specifications and drawings, of which the following is a brief description.

DETAILED DESCRIPTION OF THE PREFERRED EMBODIMENT

Figure 1:
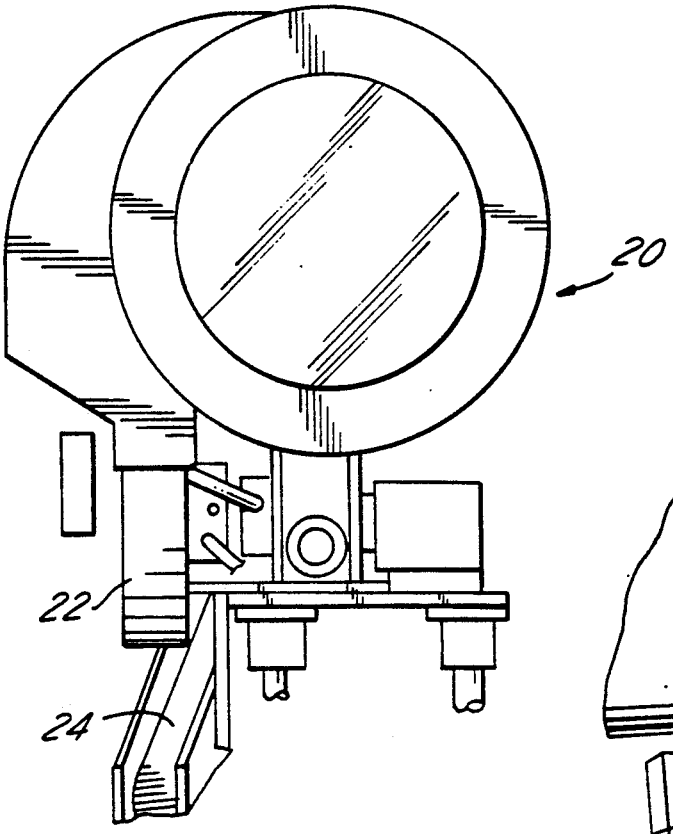
FIG. 1 is an end view of a system for placing caps on jars.

A system 20 for placing caps on jars is illustrated in FIG. 1. As shown, a chute 22 delivers caps, and a conveyor 2 moves jars to be capped along a conveyor path.

Figure 2:
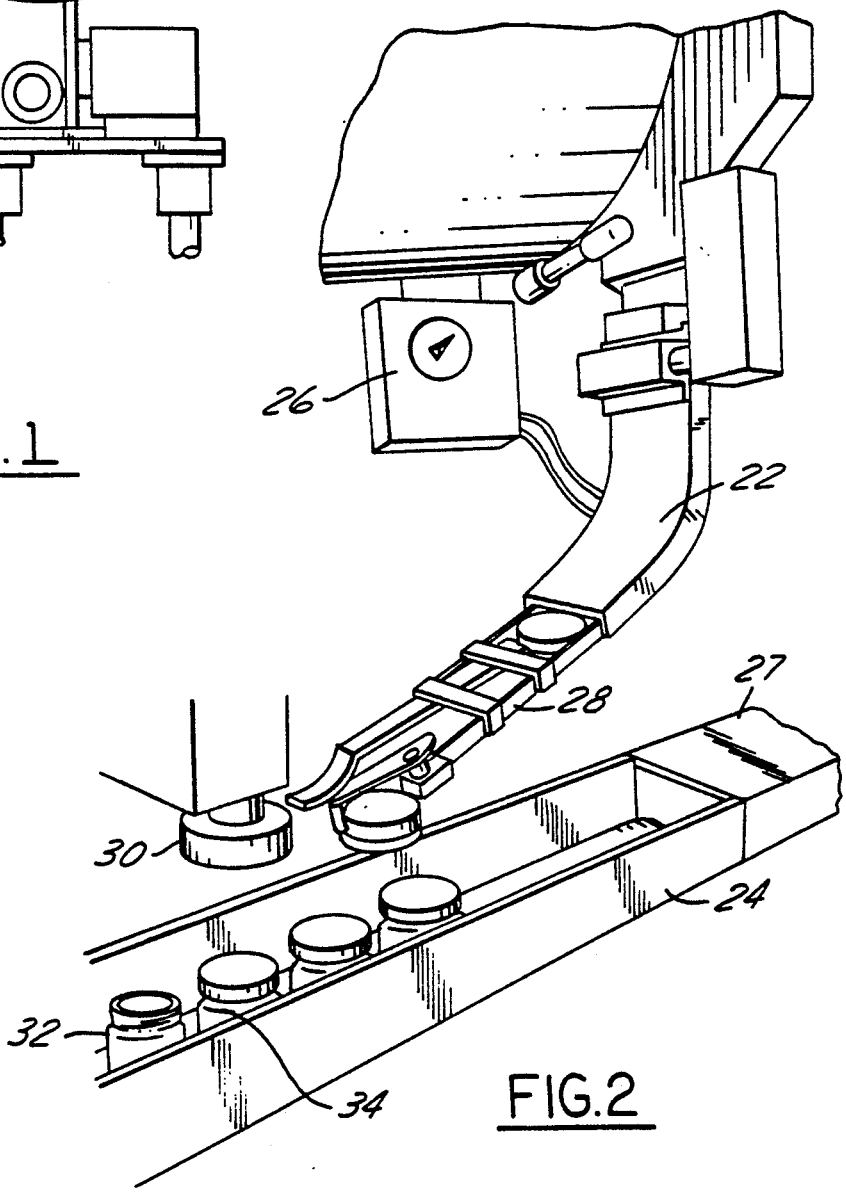
FIG. 2 is a perspective view of the system shown in FIG. 1.

As shown in FIG. 2, a controller 26 controls the various systems including a heater, described below, which is received within chute 22. A guidance structure 28 ensures that the caps are properly delivered to a capping station 30 which rotates the caps onto glass jars 32. A capped glass jar 34 is shown downstream of uncapped jar 32.

An induction heater 27 is shown schematically downstream of the capping station 30. Induction heater 27 may be any type of known heater, which heats both the jar and the cap to fully activate an adhesive and cause a seal within the cap to seat on the jar.

Figure 3:
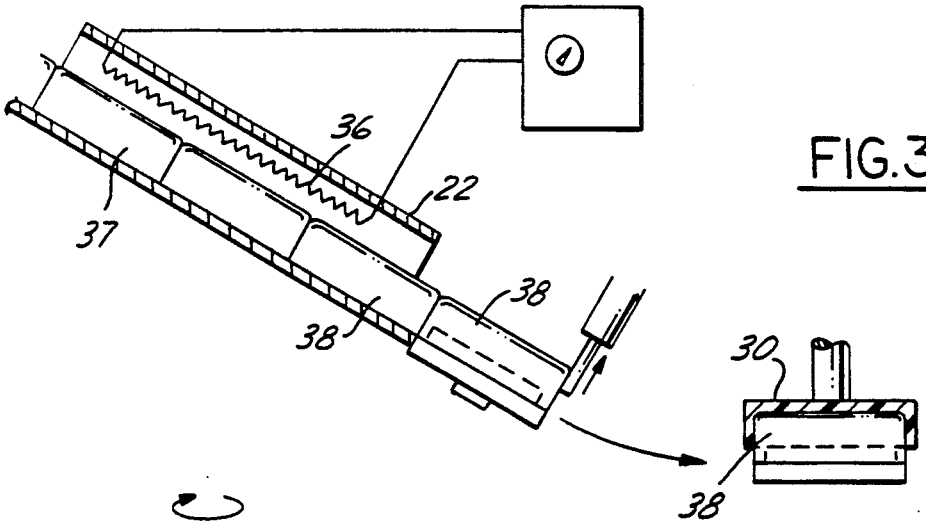
FIG. 3 is a largely schematic view of a system for delivering caps to a capping station.

As shown in FIG. 3, chute 22 includes a heating element 36. Unheated caps 37 enter chute 22 and heated caps 38 leave chute The temperature of heating element 36 is controlled such that the cap 38 reaches a desired temperature during the period it is within chute The desired temperature will change for a particular embodiment, although it is preferably within a range of 120°-250° F. Further, although a heating element is illustrated, other known heaters may be utilized.

As shown, capping station 30 takes heated caps 38 from chute 22. The structure of the capping station, the conveyors, the induction heater and the chute (other than the heating element 36), are all known in the prior art. Any known capping stations or conveyors for caps and jars may be utilized.

Figure 4:
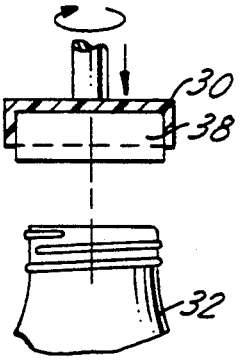
FIG. 4 is a schematic view of a device for placing caps on jars.
Figure 5:
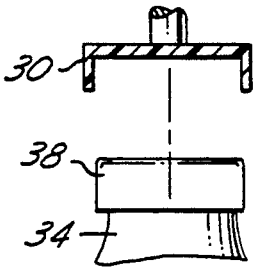
FIG. 5 is a view similar to FIG. 4.

As shown in FIG. 4, an uncapped jar 32 is aligned with a heated cap 38 under capping station 30. Capping station 30 places the heated cap 38 on Jar 32 and is withdrawn from cap 38.

Figure 6:
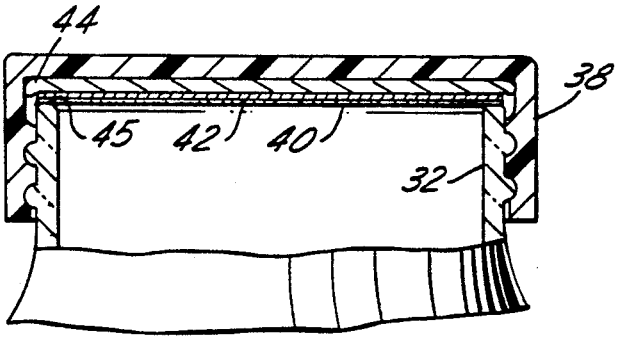
FIG. 6 is a cross-sectional view through a first embodiment of a cap placed on a jar.

As shown in FIG. 6, a capped jar 32 has received a heated cap 38. Since cap 38 is plastic, the heat applied thereto reduces the likelihood of it cracking as it is being tightened on jar 32. As shown in FIG. 6, cap 38 includes a layer of adhesive 40 placed on an inner side of an aluminum seal 42. A paperboard filler 44 is received within cap 38. Since cap 38 has been heated when it is placed on jar 32, the adhesive 40 is softened. Once cap is tightened to the position shown in FIG. 6, it forces aluminum seal 42 against an axially extending upper neck surface 45 of Jar 32. The soften adhesive begins to conform to irregularities on neck 45. In this way it is insured that the aluminum seal 42 is properly received on neck 45, resulting in a high percentage of adequate and effective seals.

The jar 32 and cap 38 are preferably not heated in the capping station 30. It is important that cap 38 be at a higher temperature than jar 32 in capping station 30. It is believed most desirable that jar 32 remain at room temperature at this point. This allows the heated cap to begin to warm the jar slowly, rather that the shock of the rapid heat as with the prior art. This allows the adhesive to slowly conform to the neck of the jar. It is believed this improves the seals formed on the jars.

Figure 7:
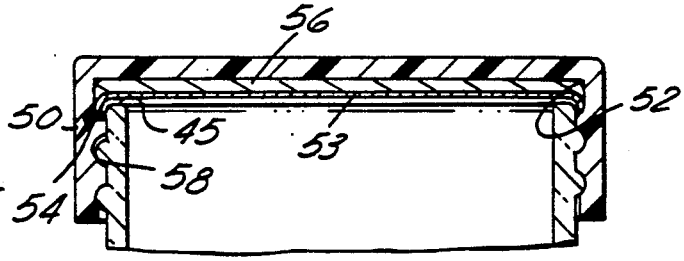
FIG. 7 is a cross-sectional view similar to FIG. 6, but showing a second embodiment of a cap placed on a jar.

As shown in FIG. 7, in a second embodiment cap 50, a curved inner surface 52 of cap 50 curls a portion of aluminum seal 53 around neck 45. In particular, aluminum seal 53 has a radially outwardly extending portion 54 which is forced downwardly along an outer peripheral surface 58 of the neck 45. In this way, seal 54 is even more likely to seal on neck 45. As also shown, a paperboard filler 56 may also have a curve to conform to surface 52.

Applicant's use of the initial heating step for the cap allows the adhesive on the seal to begin to conform to the glass jar prior to the glass Jar being heated. It is believed that the prior art methods which initially heated the jar, the cap and the seal at the same time, resulted in all three of the members expanding greatly. Resulting creepage as the three members move back to their original shape could ruin any seal between the members. With the inventive method, the seal begins to slowly seat on the jar as the heated cap is tightened on the jar. The softened adhesive begins to conform to the jar neck. When the Jar and cap are heated in the induction heater, the adhesive is then completely activated and seals on the jar. This method results in an unexpectedly high percentage of seals being properly formed on jars when compared to the prior art systems. When the cap is removed from the jar, the aluminum foil or seal remains unbroken. The seal must be broken to obtain the contents, such as mustard, from the jar.

The materials for the seal and adhesive are as known in the prior art. Preferred embodiments of the present invention have been disclosed, however, a worker of ordinary skill in the art would recognize that certain modifications would come within the scope of this invention. For that reason one should review the following claims to understand the scope and content of this invention.

I claim:

1. A method of capping a jar having a back comprising the steps of:

(a) placing a seal within a cap, the seal having an adhesive on a face facing inwardly of the cap;

(b) heating the cap and seal;

(c) placing the cap on a jar while the cap is still heated to an elevated temperature relative to the jar and with the seal having a portion extending radially outwardly beyond the neck of the jar;

(d) tightening the cap on the jar; and (e) forming the cap with a surface to curve the radially outward portion of the seal axially downwardly around the neck of the jar to provide an effective seal.

2. The method of recited in claim 1, including the step of tightening the jar and the cap at a capping station, with the capping station remaining at environmental temperature, and being unheated.

3. The method as recited in claim 2, wherein the cap is formed of a plastic, the seal is aluminum and the jar is glass.

4. The method as recited in claim 3, wherein the cap is heated in step (b) to an approximate temperature by 240° F.

5. The method as recited in claim 4, wherein the jar and the cap are sent through a second heating station downstream of the capping station.

6. The method as recited in claim 1, including the step of moving the caps through a chute to be delivered to a capping station with the heating of step (b) occurring while the caps move through the chute.

7. The method as recited in claim 1, wherein the cap is heated in step (b) to a range of 120° F. to 250° F.

8. A method of capping a jaw comprising the steps of:

(a) placing a seal within a cap, the seal having an adhesive on a face facing inwardly of the cap;

(b) heating the cap and seal;

(c) placing the cap on a jar, while the cap is still heated at an elevated temperature relative to the jar;

(d) tightening the cap on a jar at a capping station which is at environmental temperature, and is unheated; and (e) sending the jar and cap through a second heating station downstream of the capping station.

9. The method as recited in claim 8 wherein the cap is formed of a plastic, the seal is aluminum, and the jar is glass.

10. The method as recited in claim 9, wherein the cap is heated in step (b) to an approximate temperature of 240° F.

11. The method as recited in claim 10 including the steps of providing the seal with a portion extending radially outwardly beyond a neck of the jar, and forming the cap with a surface to curve the radially outward portion of the seal axially downward around the neck of the jaw to provide an effective seal.

12. The method as recited in claim 8, including the step of moving caps through a chute to be delivered to the capping station with the heating of step (b) occurring while the caps move through the chute.

13. The method as recited in claim 8, wherein the cap is heated in step (b) to a range of 120° F. to 250° F.

14. An apparatus for capping jars comprising:

a capping station;

a conveyor for moving glass jars toward said capping station;

a chute for delivering caps to said capping station for placement on glass jars moving on said conveyor;

a heater for heating the caps such that the caps are at an elevated temperature when delivered to said capping station; and a second heating station through which the assembled caps and jars are passed to elevate them to a sealing temperature after they have left the capping station.

15. The apparatus as recited in claim 14, wherein the heater is positioned within said chute.

16. The apparatus as recited in claim 15 wherein a control for the heater insured that the caps are at a temperature range of 120° F. to 250° F. when delivered to said capping station thereby thermally expanding the caps relative to the glass jars before installation thereon.

* * * * *